United States Patent [19]

Blasco

[11] 4,389,604

[45] Jun. 21, 1983

[54] SEWING MACHINE INCORPORATING A PROGRAMMABLE CONTROL AND A LOW-INERTIA MOTOR

[75] Inventor: Eduardo G. Blasco, Madrid, Spain

[73] Assignee: Industrias Y Confecciones, S.A. (INDUYCO), Madrid, Spain

[21] Appl. No.: 231,571

[22] Filed: Feb. 3, 1981

[30] Foreign Application Priority Data

Feb. 12, 1980 [ES] Spain ..... 488.504
Oct. 14, 1980 [ES] Spain ..... 495.935

[51] Int. Cl.[3] ..... G05B 19/42
[52] U.S. Cl. ..... 318/568; 112/158 E
[58] Field of Search ..... 318/568; 112/158 E

[56] References Cited

U.S. PATENT DOCUMENTS

| | | | |
|---|---|---|---|
| 4,074,642 | 2/1978 | Herr | 318/568 X |
| 4,085,691 | 4/1978 | Coughenour et al. | 318/568 X |
| 4,092,938 | 6/1978 | Coughenour et al. | 318/568 X |
| 4,108,090 | 8/1978 | Landau et al. | 318/568 X |
| 4,199,814 | 4/1980 | Rapp et al. | 318/568 X |

*Primary Examiner*—B. Dobeck
*Attorney, Agent, or Firm*—Wenderoth, Lind & Ponack

[57] ABSTRACT

A sewing machine includes as a driving element the low-inertia electric motor which is controlled by an electronic controller which receives signals from a digital/analog converter controlled by a microprogrammed controller. The low-inertia motor includes an electronic tachometer electrically connected to a speed controller which is comprised of an adjusting and control stage and a power distribution stage. The adjusting and control stage receives signals from a tachometric feed-back circuit as well as signals from a feed-back circuit of the intensity consumed by the low-inertia motor and also a reference signal from the digital analog controller. The adjusting and control stage supplies a signal of the state of motion for the coupling interphase with the controller and signals of speed control and operating speed control of the low-inertia motor. The power distribution stage comprises an alternating to direct current converter followed by a controlled direct to alternating current converter connected to the primary of a transformer having a ferrita core, the secondary of which is connected to a second direct to alternating current converter which feeds the low inertia motor. The adjusting and control stage at all times makes a comparison by means of operational amplifiers of their input signals, as a result of which comparison it porportions an output which controls the controlled direct to alternating current converter as well as a second output susceptible of activating conduction, depending on the polarity of a pair of transistors incorporated in the feed-back circuit of the low-inertia motor, which transistors control the direction of rotation of the motor.

6 Claims, 13 Drawing Figures

69
72
92
92
92
92
A
B
A
B
A
67
68
66
65
47
56
85
70
71
73
74
75
76
77
78

SEWING MACHINE INCORPORATING A PROGRAMMABLE CONTROL AND A LOW-INERTIA MOTOR

BACKGROUND OF THE INVENTION

The present invention refers to a sewing machine incorporating a programmable control and a low-inertia motor.

The sewing machine in accordance with the present invention comprises two main parts. One part consists of a control system carried out by a microprocessing device together with its accompanying elements, while the other part resides in the specific driving element thereof, consisting in the housing of a low-inertia motor controlled by an electronic controller, whereby a highly effective industrial machine, capable of performing a number of different operations, is obtained; the machine in accordance with the present invention having a surprising improvement in performance when compared with the presently existing automatic sewing machines.

The sewing machine in question is capable of automatically effecting a large variety of sewing operations, the operator not having to act on the control elements thereof since the machine effects all and each one of the operations which have previously been programmed therein or self-learned. With respect to this self-learning characteristic of the machine, it should be stated that for the machine to perform a predetermined sequence of work automatically, the operator should merely perform this sequence of work manually using the machine, so that each one of the sewing operations and phases be automatically recorded in a storage program, the machine therefore being capable of effecting said operations automatically as many times as desired.

Thus, the advantages derived from these characteristics are clear, since the machine releases the operator from having to sew, carrying this out at a greater speed and, naturally, without producing any type of error during sewing.

The control system is based on a main processing and microprocessing unit which processes the instructions of a functioning program stored in a computer, as well as the data supplied by peripheral elements of the machine, such as buttons, ends of stroke, position sensors, etc. This main unit, whose functioning is controlled by a time standard, is joined to two storage blocks consisting of a dynamic computer memory (RAM) and a static computer memory (EPROM).

The dynamic computer memory (RAM) stores the data relating to the carrying out of a predetermined sewing operation to be performed by the sewing machine. The static computer memory, augmented by three computer memories of the (EPROM) type, stores the control program which controls the behaviour of the various elements of the machine.

There are provided, as peripheral elements, a plurality of sensors, optocouplers, ends of stroke, etc. which continuously supply information about the state of the different operative elements of the machine, such as the position of the sewing needle, the housing of the thread cutting element, the position of the presser-bar, the position of the operating pedal of the machine, etc. Therefore, the main processing unit is at all times aware of the situation of the elements it controls.

SUMMARY OF THE INVENTION

The main characteristic of this sewing machine resides in the fact that it has, as the driving element, a low-inertia motor controlled by a controller, which characteristic is of outstanding importance at the time of comparing the machine of this invention with conventional sewing machines which comprise a motor provided with a mechanical clutch and brake.

Thus, the application of this low-inertia motor together with its associated electronics, to a sewing machine presents a series of novelties and advantages when compared with conventional sewing machines, among which the following could be emphasized:

First.—The motor of the machine will be completely at rest while the movement thereof is not required for sewing, differing from what takes place with the motor with which conventional sewing machines are equipped and which consume power constantly, irrespective of whether it is sewing or not. This characteristic implies a substantial saving in power, since it has been verified that the manipulation by the operator of the machine while not undertaking sewing corresponds to an elevated time in the manufacturing process inasmuch as it requires changes in orientation of the fabric, entrance thereof, observation of the sewing, etc. A conventional motor, during these times, continue turning although its turning is not transmitted to the movable elements of the machine. However, the low-inertia motor is at rest, provided that the needle does not have to be used. Thus, since the power consumption of the motor during these periods of time is avoided, a considerable saving in power is logically obtained.

Second.—The different operating speeds of the machine are obtained by applying to the low-inertia motor different voltages, wherefor said speeds are obtained accurately and without the intervention of any element which can be worn out. Conventional machines, on the other hand, obtain the different sewing speeds by using a clutch, in a greater or lesser degree of timing. Thus, it can be understood that there will be a substantial saving in materials since the parts which are constantly worn out are discarded and periodic inspections as well as the replacement or worn out elements are prevented.

Third.—There is likewise a substantial improvement at the time of automatically stopping the machine, since, with the low-inertia motor, stopping is achieved by merely applying an inverse voltage at the terminals thereof during the required deceleration period. On the other hand, with the conventional motors stopping is achieved by pressing a mechanical brake, subject to wear, as in the case of the brake mentioned in the preceding paragraph. Thus, a high precision in the stopping of the motor is not obtained.

Fourth.—The different operating speeds of the motor is obtained by varying the input signals of the digital-/analog converter circuit which controls the control circuit of the motor, thereby obtaining a wide range of speeds which, in the embodiment of the invention, can vary of from 0 to 256 different speeds as a result of the 8 bits which define the digital information of the speed for the motor.

Fifth.—As a result of the way in which the different operating speeds are obtained, the maximum operating speed of the motor will only be limited by the operative capacity of the sewing machine, wherefor the productive yield thereof can approach very high percentages when compared with that obtained with conventional technology.

Sixth.—Besides all the previously mentioned advantages, a sewing machine made with the technology of the present invention is slightly less expensive than a machine provided with a conventional motor based on a clutch and a brake.

The low-inertia motor is controlled by a speed controller which receives signals from a digital-analog converter and which is joined to a feed back block of the state of motion of the motor, this digital-analog converter and the feed-back block constituting a coupling interface with the already mentioned main processing unit. The main processing unit takes over the control of the low-inertia motor in order to achieve different operating speeds at the appropriate moments thereof, and to achieve stopping of the machine at the appropriate time with the sewing needle in its correct position, i.e. with the needle in a raised or lowered position.

In short, the sewing machine of the present invention is comprised of three large functional blocks. The first block corresponds to the main processing unit, controlled, as mentioned, by a microprocessing device, preferably of the known Z-80 type. The second block corresponds to the low-inertia motor with its accompanying circuits which make the presence of a low-inertia motor compatible with a sewing machine. The third block corresponds to all the peripheral elements, such as sensors of the position of the needles, presser-bars, electronic tachometers, circuits of the operating pedal, electrovalves, etc., which elements supply the pertinent information to the main processing unit.

Consequently, the thus constituted sewing machine forms a highly interesting industrial instrument since it is capable of producing a practically unlimited number of operations which release the operator from controlling and handling the garments to be made, with the important characteristic that the machine itself is capable of self-learning the various operations by merely carrying out each specific operation once.

BRIEF DESCRIPTION OF THE DRAWINGS

To complement the description which will subsequently be made, please refer to the attached set of drawings, is attached to wherein.

Figure 1:
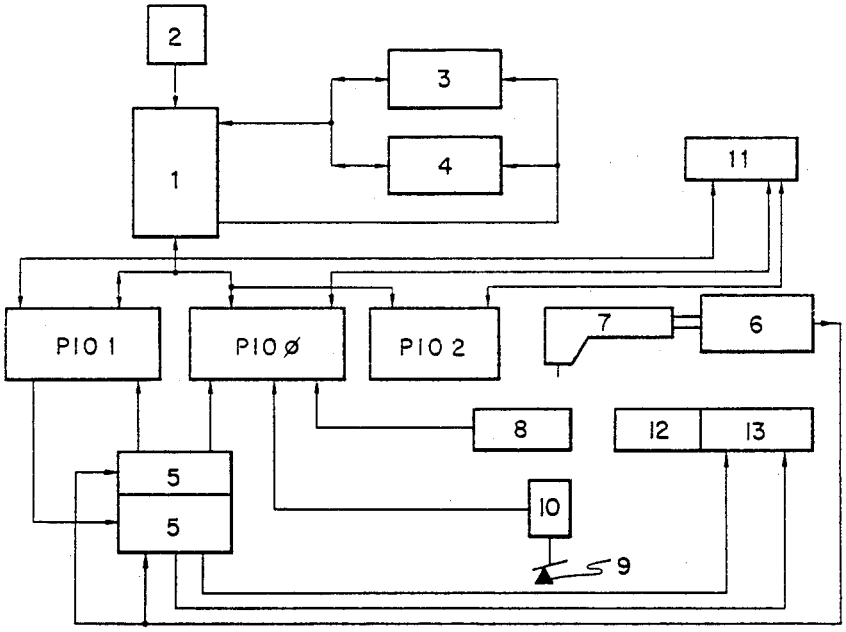
FIG. 1 represents a block diagram of the sewing machine made in accordance with the invention.

NOTE: In the complete set of drawings, the encircled reference numerals indicate the continuity of the connection between the different figures. On the other hand, the simple numerical references indicate the different functional parts of the system.

DESCRIPTION OF THE PREFERRED EMBODIMENT

Referring to the figures and firstly to the functional organization represented in FIG. 1, there can be seen a sewing machine with a programmable control and a low-inertia motor made according to the invention, comprised of a microprocessing device 1 controlled by a clock circuit 2 or a standard frequency generator, the microprocessing device 1 being directly connected to the storage block in the dynamic computer memory 3 (RAM) and to a storage block in the static computer memory 4, augmented by three identical storage units of the (EPROM) type. The dynamic computer memory 3 stores the different data for carrying out a predetermined sequence of work, while the static computer memory 4 stores the operating and controlling program of the data by means of which the machine continues its operation.

The thus formed assembly is connected to the outer peripheral elements which control the machine with the help of three input/output units which will hereinafter be called P10 $\phi$, P10 1, and P10 2. There is provided a decoder circuit or a logic/analog converter 5 which transforms the character of the signals entering these input/output units or leaving same.

Continuing with the block diagram of FIG. 1, it can be said that the block 6 corresponds to a block synchronizer which programs the different functions of the mechanical elements of the sewing machine 7. Likewise the block 8 includes a safety circuit for the thread cutting device of the machine 7 which prevents the sewing needle from being lowered when the thread cutting device has not yet been withdrawn from its operative position and the operating pedal of the sewing machine 9 is joined to the electronic block 10 which comprises a series of electronic circuits, normally optoelectronic sensors, which detect progressive positions of the operating pedal 9 of the machine and by means of which the different sewing speeds are obtained.

Figure 4:
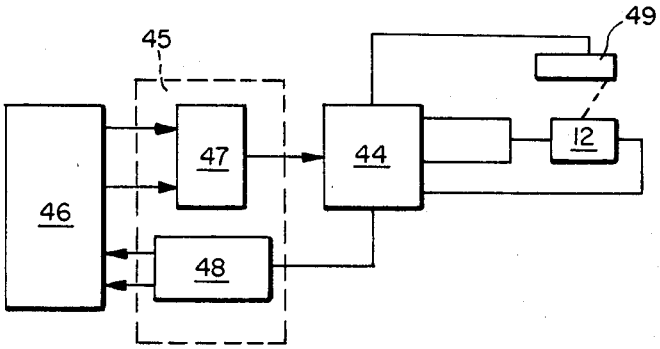
FIG. 4 corresponds to a block diagram of the organization pertaining to the control of the low-inertia motor and which receiving information from the main processing unit controls said motor.

Likewise, there has been provided a keyboard 11 with which modifications and controls can be introduced for the operation of the machine. As can be seen, the motor 12 is joined to the block 13, the schematic organization of which is illustrated in FIG. 4 of the accompanying drawings.

Implementation of the control system of the sewing machine will now be described in more detail.

As previously mentioned, the control system is based on a microprocessing device 14 which is joined to three computer memory blocks of the (EPROM) type 15 and a (RAM) computer block memory 16, all of which are logically connected to the direction bus A $\phi$, A1 . . . A14, as well as to the data bus D $\phi$, . . . D7. The microprocessing device 14 is controlled by a clock circuit 2 represented in the block diagram of FIG. 1, which can be either one of two versions, one of which is based on an astable multivibrator 17 or by means of a quartz crystal circuit 18, the signals of which are sent to a counter-divider 19 connected to block 20 or CTC (counter and timer circuit). This CTC block 20, besides serving as a connecting means of the clock signals for the microprocessing device 14, performs a peripheral operation since it receives the signals from a device 21 for counting the stitches made by the machine, which device 21 is based on a wheel which is permanently maintained in contact with the cloth to be sewn and which produces a series of electric pulses while the fabric passes below the sewing needle, sending said pulses to the mentioned CTC block 20.

Figure 3:
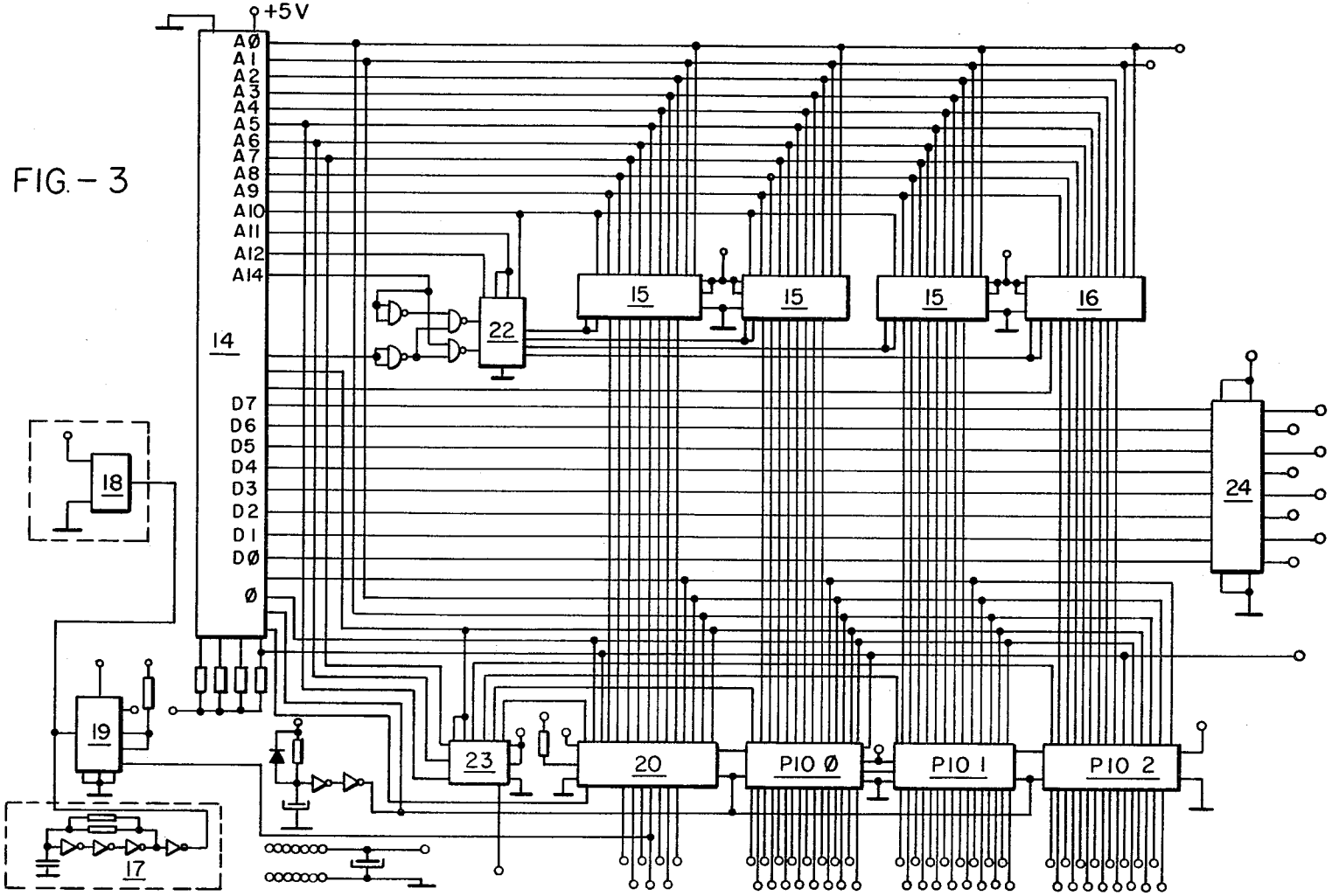
FIG. 3 represents a block diagram of the main processing unit, in which there can be seen the microprocessing device, the computer blocks and the input and output units.

The scheme of FIG. 3 illustrates the presence of the decoders 22 and 23 provided for the correct processing of the signals of the microprocessing device, as well as the buffer 24 placed at the output of the data bus.

The input-output lines corresponding to P10 $\phi$, P10 1 and P10 2, are the means through which the main processing unit or control system receives the information from all and each one of the peripheral elements, such as the signals from the synchronizer block 6 of the circuits 10 of the pedal 9, from the controller 13 of the low-inertia motor, from the control panel 25, from the finishing off button 26 and from all the electrovalves incorporated in the sewing machine, through the power stage 27. From these electrovalves, the following should be emphasized: electrovalve 28 pertaining to the presser-bar, electrovalve 29 for finishing off the sewing, electrovalve 30 for positioning the thread cutting device in an operative position, electrovalve 31 for maintaining the thread cutting device controlled, and electrovalve 32 as a reserve of the stacking element of the machine.

Figure 2:
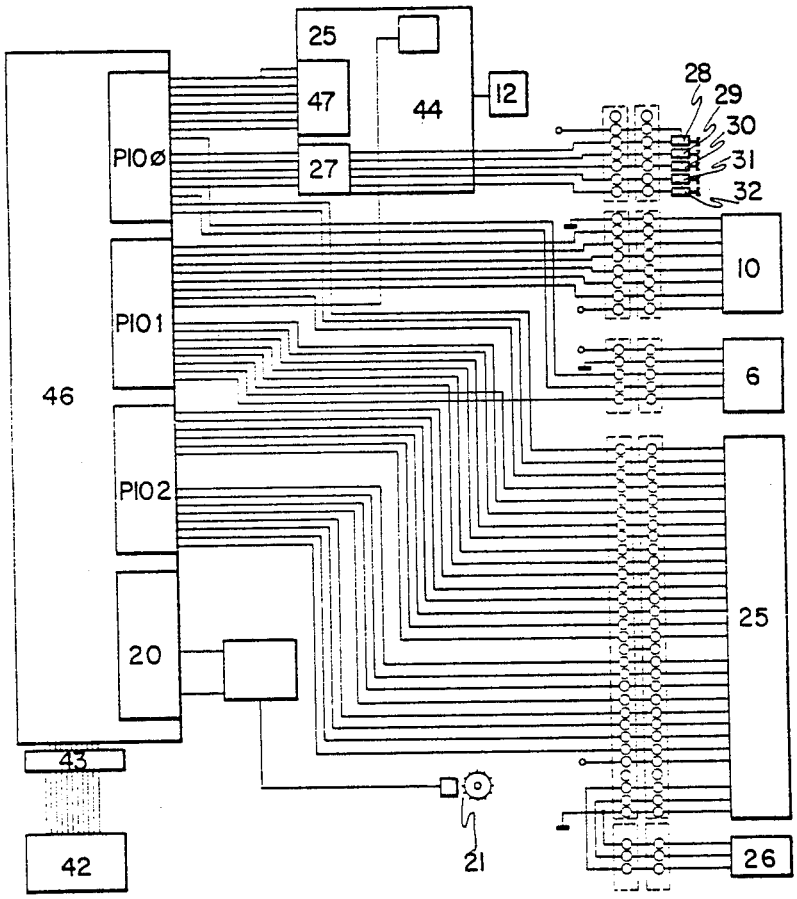
FIG. 2 represents a functional scheme of the different parts comprising the machine.

FIG. 2 of the accompanying drawings clearly illustrates the distribution of all these input-output lines.

Figure 11:
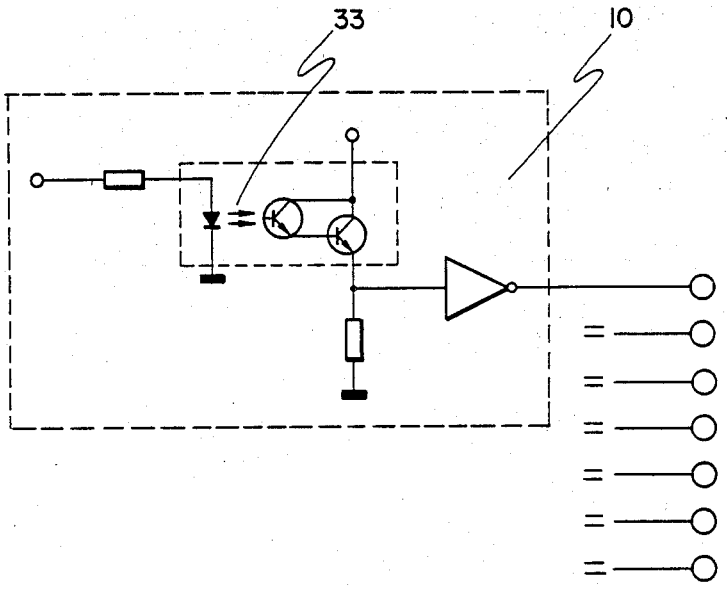
FIG. 11 corresponds to one of the different electronic circuits, identical to one another, with which the operating pedal of the sewing machine is provided and by means of which the different operating speeds are obtained.

FIG. 11 describes one of the N-circuits, identical to one another, used to detect the different operative positions of the operating pedal 9 of the machine. Basically they consist of optocouplers 33 which send their signal to the input-output unit P10 1.

Figure 13:
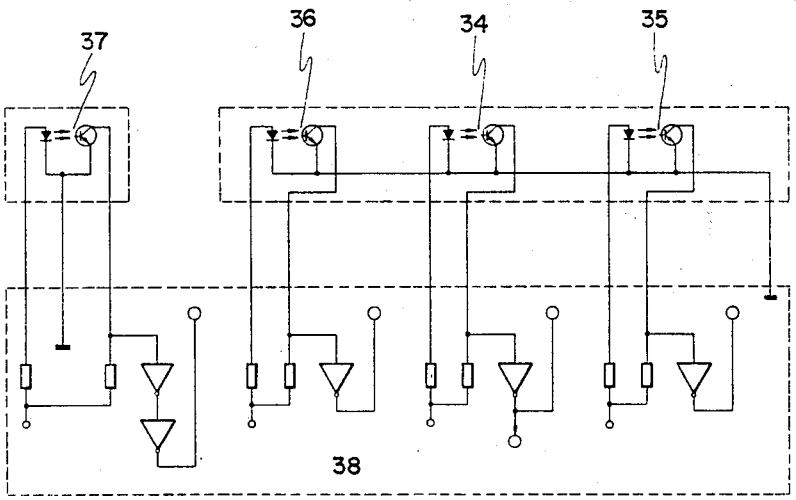
FIG. 13 represents the electronic circuit of the synchronizer block illustrated in FIG. 1, and the safety circuit for positioning the thread cutting devices.
Figure 12:
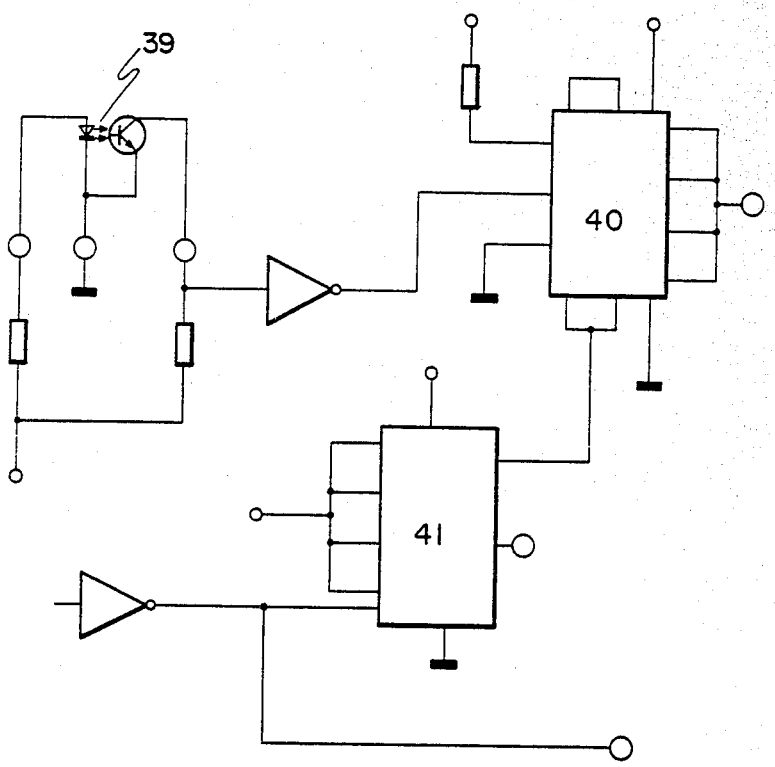
FIG. 12 illustrates the electronic circuit used for detecting the breakage of the sewing thread.

FIG. 13 represents the circuit of the synchronizer block 6 and that of the safety block 8 of the thread cutting device. The synchronizer 6 comprises a plurality of sensors for controlling and detecting the different operative positions of the needle and the thread cutting device. The sensors which detect the relative position of the needle in its raised or lowered position are associated with two optoelectronic devices, 34 and 35 which permanently indicate to the microprocessing device the operative position of the needle. Similar sensors 36 and 37, respectively, act as a control of the thread cutting device in its cutting position, and as the cutter of the thread cutting device at rest, i.e. in the return position of the thread cutting device. The information facilitated by these elements prevents the needle of the machine from being lowered when the cutter of the thread cutting device operates, a fact which would inevitably imply breakage of the needle. The signals supplied by these optoelectronic sensors 34, 35, 36 and 37 are processed by the circuit 38 which communicates with the pertinent lines of the input-output units.

To detect the breaking positions of the thread and prevent the machine from operating in the absence of sewing thread, there is provided an optoelectronic sensor 39 connected to the displacement recorder 40 and to a master/slave JK flip-flop 41.

The machine incorporates the alphanumeric display 42 connected to the control system or the main processing unit through the driver 43, this display 42 constituting an information means for the operator of the different operative positions of the machine.

With the aforementioned structure, the machine is automatically controlled, irrespective of the type of motor used. However, the present invention complements said structure by incorporating into the machine a driving element consisting of a low-inertia motor controlled by a speed controller which, in turn, logically depends on the main processing unit, previously mentioned.

The structure of the low-inertia motor and its speed controller will now be described, the functional organization of which is represented in FIG. 4 of the accompanying drawings.

The motor 12 is fed by a speed controller 44 connected to a coupling interface 45 with the upper controller or main processing unit previously described and represented in said FIG. 4 by the generic block 46. The coupling interface 45, in turn, comprises a digital-/analog converter 47 and a feed-back block 48 of the state of motion. Besides, the motor 12 incorporates an electronic tachometer 49 which is connected to the speed controller 44.

Figure 5:
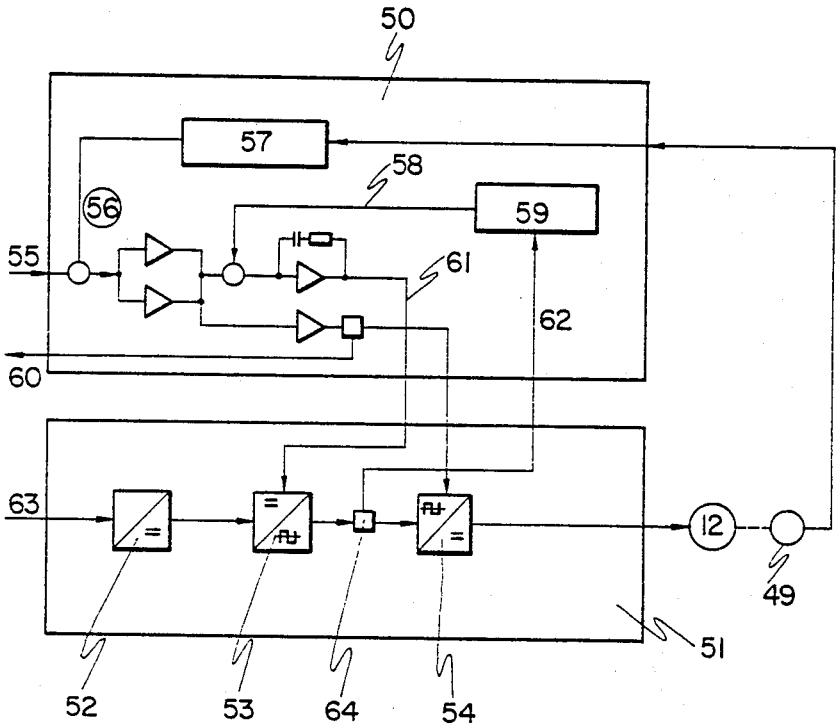
FIG. 5 represents the intrinsic organization of the speed controller itself, of the low-inertia motor, in which there can schematically be seen two large blocks, one of which, the upper, corresponds to the structure of the speed adjusting circuit, while the lower block corresponds to the structure of the power circuit which feeds the motor.

The speed controller 44 is schematically represented in FIG. 5, where there are two large functional blocks. Block 50 represents the structure of the speed adjusting circuit of the low-inertia motor 12, the inputs of which circuit are the signals of the digital/analog converter 47, as well as the current feedback signal of block 48 and the signal of the tachometer 49. The output of this block 50 is the signal which informs about the state of motion of the low-inertia motor 12.

The other block 51 of the FIG. 5 represents the structure of the power stage used to drive the motor 12, this block 51 consisting of an alternating/direct current converter 52, followed by a direct/alternating amplitude controlled converter 53 which is connected to a direct/alternating current converter 54 which can be controlled in both directions.

Thus, the speed controller 44 is connected to the low-inertia motor 12 and provides it with the necessary information so that the different movements as well as the braking thereof can be effected in correspondence with the signals entering same from the upper controller 46 or main processing unit described. The operating speed of the motor 12 is known by means of the electronic tachometer 49 which sends the pertinent information to the speed controller 44.

With respect to this speed controller 44, it should be stated that its block 50, illustrated in FIG. 5, receives at its input 55 the signal from the digital/analog converter 47 incorporated in the already described coupling interface 45 to the upper controller 46. Likewise it receives along the line 56 the signal from a feed-back circuit 57 of the tachometric signal, and along the line 58 the signal from the current feed-back circuit 59. This block 50 produces a signal along the line 60 which contains information about the state of motion of the low-inertia motor 12 at each moment, a signal which is sent to the coupling interface 45 with the upper controller 46. This block 50 is connected by these lines 61 and 62 to the block 51 in order to provide the speed control and the direction of rotation control for the low-inertia motor 12.

The block 51 receives along the line 63 the feed current at a frequency of 50 cycles per second, affecting the alternating/direct current converter 52 and producing at its output a rectified current. This block 52 communicates with the controlled direct-alternating current converter 53, a transformation at a frequency in the range of 20 Kc/s being produced. With these two conversion states 52 and 53, the electric network has passed from 50 c/s to 20 Kc/s. Therefore, since the circuits operate at this high frequency, the dimensions of the transformer 64 used to feed the motor 12 are of a minimum volume, inasmuch as the use of transformers having ferrite cores is permitted which, apart from the minimum dimensions thereof, proportion a great yield to the feed.

This transformer 64 is followed by a block of the alternating-direct current converter 54 which is directly associated to the low-inertia motor 12, supplying it with the necessary electric power for its movement and turning it at a suitable speed in one direction or the other.

It should be pointed out that by virtue of the above-mentioned structure, conventional metal-cored transformers are eliminated, which transformers make the prior art automatic sewing machine heavy in weight, bulky in volume and high in production costs and which, besides said inconveniences, present thermal problems in functioning as well as a high energy consumption.

Figure 6:
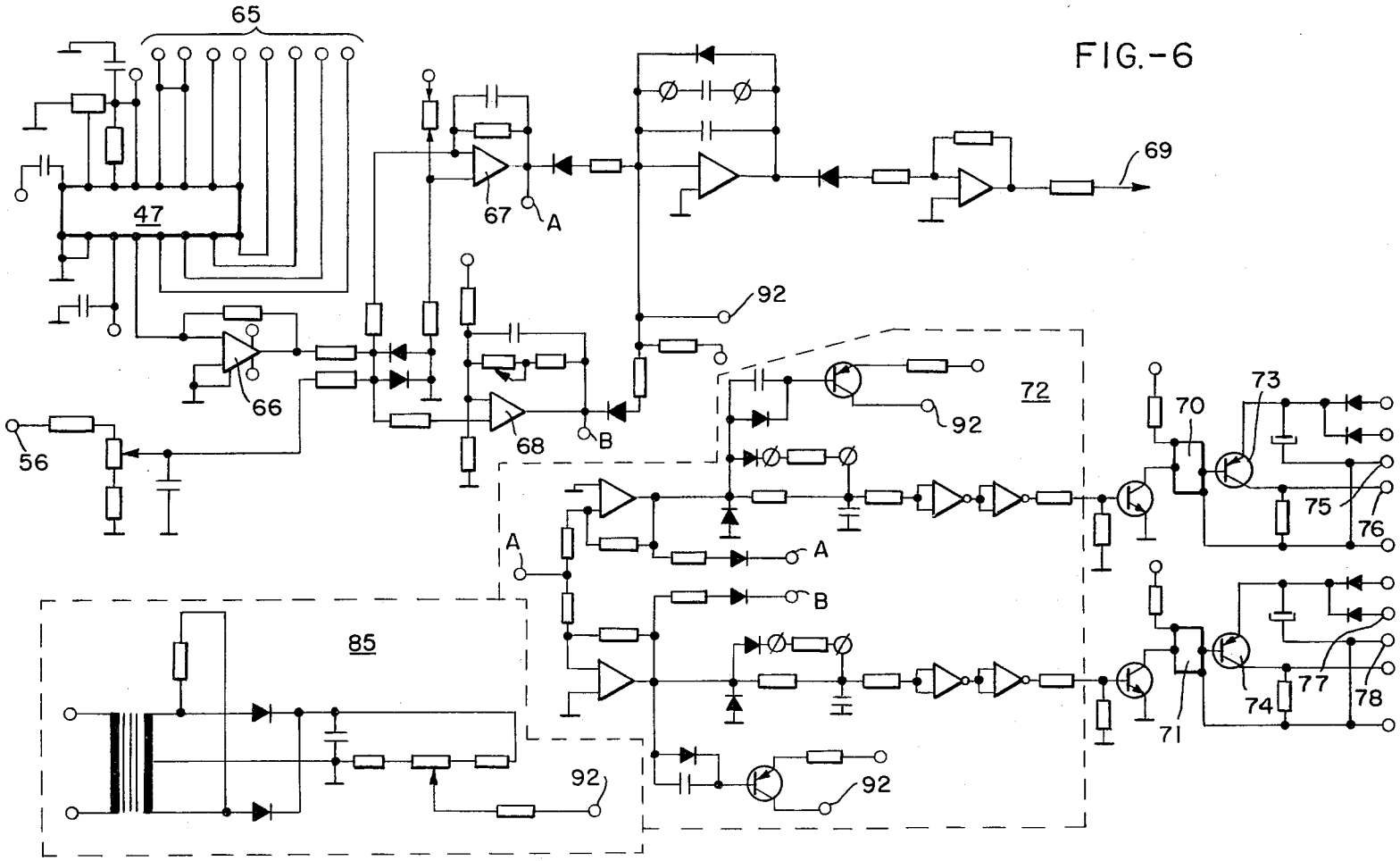
FIG. 6 corresponds to the control circuit of the low-inertia motor.

Block 50 is represented in the theoretical circuit illustrated in FIG. 6, which circuit at its inputs 65 receives the signal from the upper controller 56 or the main processing unit and which affect the digital/analog converter 47, provided the speed code for the motor and obtaining at the output of this D/A converter 47 an output signal which is applied to the operational amplifier 66 whose output is distributed between the operational amplifiers 67 and 68. This block receives, through 56, the signal from the tachometric feed-back circuit 57. Depending on the result of the comparison between the reference voltages produced by the D/A converter 47 and by the tachometric feed-back signal received in 56, one of the operational amplifiers 67 or 68 will be activated, obtaining a signal at 69 which will be sent to the trip circuit of FIG. 7, a circuit constituted by the block 53 or the controlled direct to alternating current converter, according to the functional scheme of FIG. 5. Besides, a current signal corresponding to the current passing through the transformer 64 is received in this control circuit, a signal which is de-energized by the operational amplifiers of this control circuit, thereby producing the signal which will stabilise the speed of the motor, depending on the intensity passing through the transformer 64.

Depending on which of the operational amplifiers 67 or 68 is activated, which, as previously said, is the result of the comparison between the signal sent by the D/A converter 47 and the tachometric feed-back signal 56, one of the optocouplers 70 and 71 will be activated.

Figure 8:
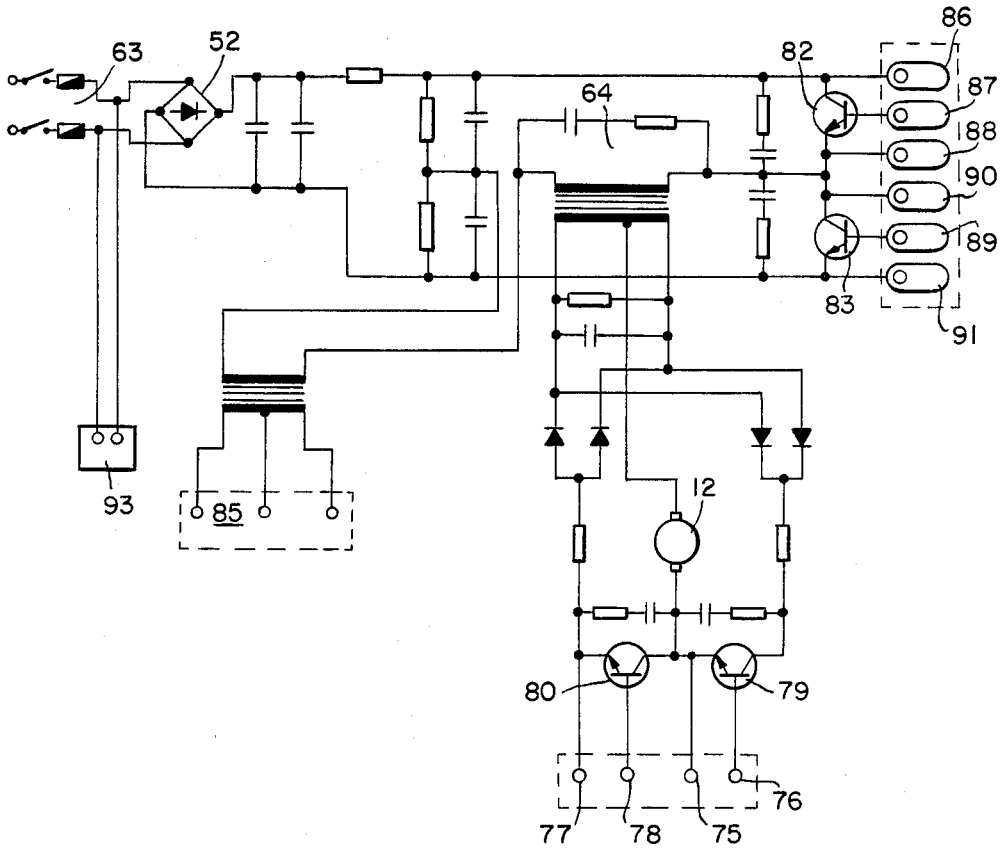
FIG. 8 corresponds to the power circuit with the various elements which control the functioning of the low-inertia motor.

These optocouplers follow a delay step 72 and are connected, respectively, to the bases of the transistors 73 and 74, to activate by means of their outputs 75–76 or 77–78 the transistors 79 or 80, which determine the direction of rotation of the low-inertia motor 12 to which they are connected as illustrated in FIG. 8 of the drawings.

The signal obtained at point 69 of the circuit illustrated in FIG. 6 is applied to the integrated circuit 81 which produces two series of pulses, the width of which pulses depend, precisely, on the signal being received at the point 69.

These two series of pulses never appear overlapped in time, so that the transistors 82 and 83 of the power distribution circuit, illustrated in FIG. 8, never switch simultaneously.

Figure 7:
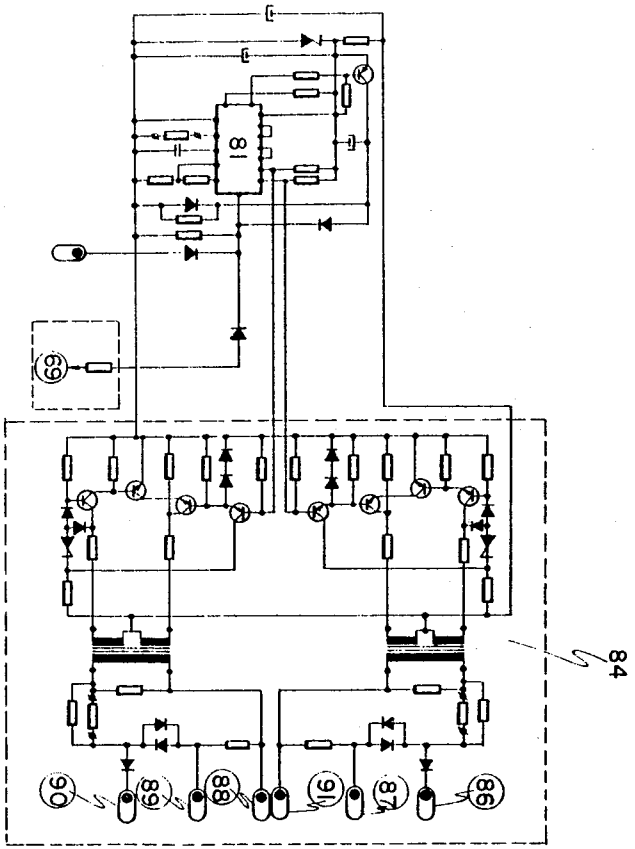
FIG. 7 represents the trip circuit by means of which the turn of the motor is controlled.

The purpose of block 84 illustrated in FIG. 7, is to control the transistors 82 and 83 with a high switching speed, sending pulses to the bases of said transistors which, in their descending side, pass through the OV level and become negative to then again become positive, which configuration turns on and cuts off the afore-mentioned transistors 82 and 83 swiftly.

This circuitry permits the control of the low-inertia motor 12, discarding the bulky conventional transistors which, due to the volume, weight and excessive consumption thereof, will make the operability of the sewing machine less effective. The transistors used in this circuitry have a reduced size and proportion and a much higher production yield due, precisely, to the high frequency at which they operate.

Figure 9:
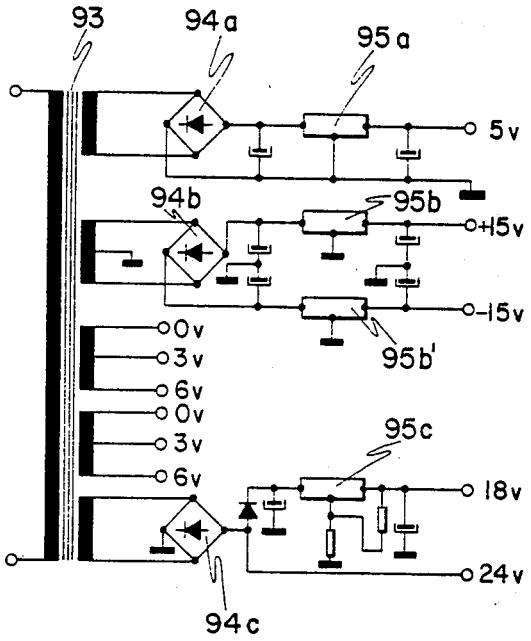
FIG. 9 represents the scheme of the source of feed used.

The complete electronic unit of the sewing machine is fed by a power source which, merely by way of illustration, is represented in FIG. 9 in which the element 93 is a transformer provided with different outputs to which are applied the rectifying bridges **94*a*, 94*b* and 94*c*, the input signal of which is rectified and controlled by integrated regulators 95*a*, 95*b*, 95*b'* and 95*c***.

The different voltages for the functioning of the various electronic devices with which the sewing machine of the present invention are provided are obtained with this power source.

Figure 10:
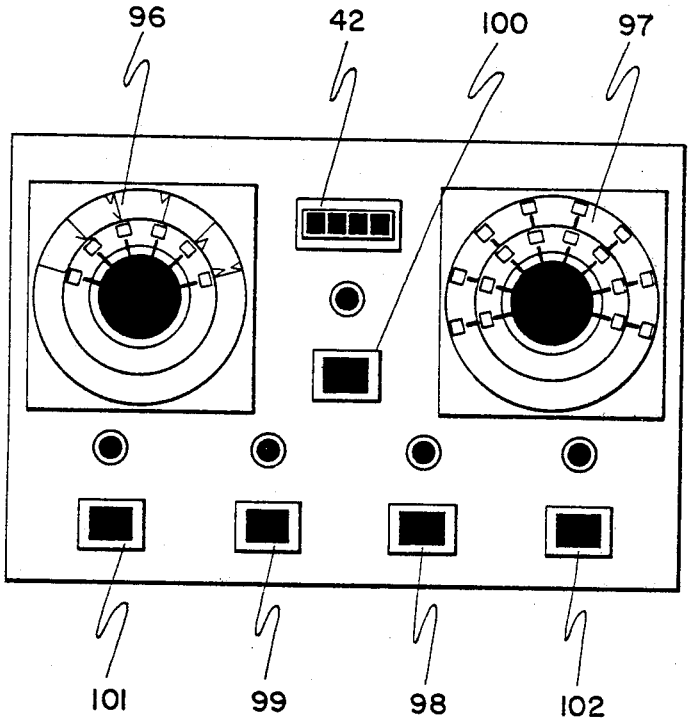
FIG. 10 illustrates, merely by way of illustration, the control panel for the operator of the sewing machine.

FIG. 10 illustrates a mode of embodiment of the control panel 25, which will be accessible to the user to control the machine, and which incorporates the alphanumerical display 42 constituting the information and communication element for the user of the different functional stages of the sewing machine. The switches 96 and 97 are used to select the types of stitches to be carried out by the machine. When same functions manually, this can be selected by the switch 98. Likewise, when the machine operates automatically, the speed can be selected by activating the switch 99.

The switch 97, operated manually, is used to select the number of stitches, while said switch automatically corrects the length of the stitches to be made by the machine when the data input switch 100 has been pressed.

The keys 101 and 102 are used to select the operation to be carried out by the machine and to place the machine in a learning position. In this learning position, the machine automatically acquires all of the data necessary to subsequently carry out, on its own, the sewing operation which it learns. Thus, the operator should merely carry out manually the operation in question once.

All the afore-mentioned switches or keys are accompanied by their corresponding LED constituting an indicative element of the operative position of the machine at all times.

A sewing machine with an automatic control and a low-inertia motor which constitutes the object of the invention is obtained with this structure.

Amongst some of the characteristics which the machine is capable of carrying out, can be cited the fact that the machine can carry out a completely normal sewing, without any automatic function, or it can sew completely automatically, effecting finishing off stitches both at the beginning and at the end of the sewing operation. The number of finishing-off stitches is selected by means of the corresponding switch.

Likewise, when the machine is learning, i.e. when the machine is storing data corresponding to a predetermined which the operator has carried out manually, the machine is capable of correcting the sewing, once it has been learned, eliminating the differences in length of the learned sewing operation which the operator, throughout his work, has involuntarily introduced. Besides, due to its storing capacity the machine is capable of carrying out different and complicated sewing operations, a highly interesting fact in the operative production of the sewing machine.

With regard to the speed controller which controls the low-inertia motor, it should be said that same is controlled by digital information. Therefore, it is possible to obtain a wide range of operating speeds, the maximum speed of the motor being only limited by the operative capacity of the sewing machine. Besides, one of the main characteristics of this structure resides in the fact that it is not necessary to apply any mechanical brake to obtain the instantaneous stopping of the motor, but, on the contrary, it is sufficient to apply an inverted polarity signal to the feed terminals of said motor, whereby the instantaneous stopping is achieved. As previously mentioned, the polarity of the input signal to said motor is by the conduction or not of the transistors 79 or 80.

Functioning of the complete control system of the low-inertia motor will now be described in the following situations: (a) acceleration (b) deceleration and (c) stopping of the motor.

(A) Acceleration

When the upper controller 46 wishes to initiate movement of the motor 12, it supplies a binary code suitable to said situation to the D/A converter 47, an error-in-speed signal appearing at the output thereof, which signal applied to the input of the speed controller 44 will produce the movement of the motor 12 until the speed, pre-established and defined by the afore-mentioned binary code supplied by the controller 46 or the main processing unit, is reached. Simultaneously, the feedback of the state of motion obtained from the block 48 indicates to the controller 46 whether the pre-selected speed has been reached or not.

(B) Deceleration

When the speed corresponding to the binary code applied to the D/A converter 46 is lower than the actual speed of the motor-sewing machine system, the voltages at the terminals of the motor 12 will be inverted, provides that there is a negative difference, this inversion disappearing when the new desired lower speed is reached.

As in the case of acceleration, the feedback of the state of motion controlled by the feedback block 48 of the state of motion, indicates whether the new lower requested speed has been reached.

(C) Stopping of the motor

The system is set at the minimum sewing speed, as described in the deceleration paragraph, and once this is reached, the approach to the stopping position is awaited, introducing an adequate speed in the proximity of the stopping point, which originates a definite decrease in speed and once the absolute point is reached, the motor is disconnected by applying to the D/A converter 47 a zero speed.

Consequently, with the structure described throughout this specification, the sewing machine thus made is capable of being used in a normal or completely automatic way, thereby releasing the operator from controlling the number of stitches of a sewing operation, the speed of the needle, and all the different variables which should be controlled when working with textile fabrics. As previously mentioned, the automation of the assembly is carried out by means of the microprogrammed control of the various operative elements of the machine, the different operations to be performed can be selected by using a keyboard accessible to the user which permits the input of different parameters related to each one of the operations to be effected by the machine. Likewise, the assignment of all these parameters can be completely controlled by the sewing machine through the adequate information controlled by the control to the information stored in the computers of the control system.

Due to the complementary structure as well as the presence of a low-inertia motor and its speed controller, this sewing machine is a highly important instrument in the textile industry.

I claim:

1. A sewing machine, having a programmable control and a low inertia motor, comprising:

an upper microprogrammed controller comprising a microprocessor operatively connected to a static computer storage block and a dynamic computer storage block;

a plurality of input/output means operatively connected to respective sensor means, each of said sensor means providing an output related to a specific operating parameter of said sewing machine;

an electronic speed controller means for controlling the speed of said motor, said controller means operatively connected to and receiving signals from a digital/analog converter which is operatively connected to said upper microprogrammed controller;

a tachometer which is operatively electrically connected to said electronic speed controller means and which provides an output proportional to the speed of said motor;

said electronic speed controller means comprising an adjusting and control stage and a power distribution stage;

a tachometric feedback means operatively connected between said tachometer and said adjusting and control stage for providing a signal corresponding to the speed of said motor;

a current feedback means operatively connected to said motor and said adjusting and control stage for providing a signal corresponding to the current supplied to said motor;

said adjusting and control stage further receiving a reference signal generated by said digital/analog converter;

said power distribution stage comprising an alternating current to direct current converter means powered by an AC power source and operatively connected to a controlled direct current to alternating current converter means connected to the primary winding of a transformer whose secondary winding is connected an additional alternating current to direct current converter means connected to said motor;

said adjusting and control stage operatively connected to said controlled direct current to alternating current converter means and to said second alternating current to direct current converter means;

wherein said controlled direct current to alternating current converter means produces an output having a first frequency which is much higher than the frequency of said AC power source, whereby the size and weight of said transformer may be reduced;

and wherein said electronic speed controller controls the speed of the motor in dependence upon a comparison between said tachometric feedback signal and said reference signal and in dependence upon said current feedback means.

2. A sewing machine as in claim 1, wherein said respective sensor means comprise one of either optoelectronic sensors, or limit switches or electrovalves.

3. A sewing machine as in claim 1, wherein said transformer has a ferrite core.

4. A sewing machine as in claim 1, wherein said power distribution stage comprises a pair of output transistors.

5. A sewing machine as in any one of claims 1–4, wherein said frequency is on the order of 20 KHz and said frequency of said AC power source is on the order of 50 Hz.

6. A sewing machine according to claim 5, wherein said controlled direct current to alternating current converter means comprises an integrated circuit connected to an additional pair of output transistors, said integrated circuit generating two series of non-overlapping rectangular pulses whose width is dependent upon said input to said converter means and said two series of pulses respectively controlling said additional pair of output transistors.

* * * * *